United States Patent [19]

Musso

[11] Patent Number: 4,942,913

[45] Date of Patent: Jul. 24, 1990

[54] WALLET

[76] Inventor: John A. Musso, 3737 Medea Creek, Agoura Hills, Calif. 91301

[21] Appl. No.: 361,246

[22] Filed: Jun. 5, 1989

Related U.S. Application Data

[63] Continuation-in-part of Ser. No. 267,932, Nov. 7, 1988, abandoned.

[51] Int. Cl.[5] ..... A45C 1/06; A45C 11/18; A45C 11/32

[52] U.S. Cl. ..... 150/138; 150/145; 150/147; 150/149; 206/37.4; 206/38.1; 206/39

[58] Field of Search ..... 150/138, 147, 149, 143, 150/145, 150; 206/37.1, 37.4, 38.1, 39; D3/56

[56] References Cited

U.S. PATENT DOCUMENTS

| | | | |
|---|---|---|---|
| D. 256,187 | 8/1980 | Miles | D3/56 |
| 1,693,006 | 11/1928 | Thomas | 206/38.1 |
| 1,832,625 | 11/1931 | Gardner, Jr. | 150/149 X |
| 2,066,526 | 1/1937 | Gladstone | 206/37.4 X |
| 2,468,817 | 5/1949 | Duchin | 206/39 |
| 2,704,101 | 3/1955 | Wittrien | 150/138 X |
| 2,725,913 | 12/1955 | Horwin | 150/147 |
| 3,647,056 | 3/1972 | Jacobson et al. | 150/147 X |
| 3,970,130 | 7/1976 | Casey | 150/149 |
| 4,417,612 | 11/1983 | Couture et al. | 206/37.4 |
| 4,722,376 | 2/1988 | Rhyner | 150/147 |

FOREIGN PATENT DOCUMENTS

| | | | |
|---|---|---|---|
| 548689 | 10/1942 | United Kingdom | 150/138 |

*Primary Examiner*—Sue A. Weaver
*Attorney, Agent, or Firm*—Jack C. Munro

[57] ABSTRACT

An incorporating of a separate sub-wallet within a conventional wallet wherein the sub-wallet can be removed and utilized when it is not necessary to carry the entire wallet. The sub-wallet includes a currency carrying compartment and a separate credit card carrying compartment. Appropriate identification papers can also be carried in the credit card compartment. There will also be included within the currency carrying compartment a separate key compartment.

1 Claim, 2 Drawing Sheets

WALLET

REFERENCE TO PRIOR APPLICATIONS

This application is a continuation-in-part of U.S. patent application Ser. No. 267,932, filed, Nov. 7, 1988, by the same title and now abandoned.

BACKGROUND OF THE INVENTION

The field of this invention relates to wallets and more particularly to a wallet which is designed to organize and facilitate carrying only a few essential items.

The use of wallets by human beings is well-known. Wallets are designed to carry articles. Typical articles are credit cards, currency, business cards, pictures, keys, identification cards, licenses (such as a driver's license), plus assorted other paper items. The result is that the wallet becomes bulky in size and if carried in one's trousers, the wallet can produce a significant bulge.

Many times, it is not necessary to carry an entire wallet. For example, if an individual was going to go out for an evening, such as to a play, it is really only necessary that the individual carry possibly some identification, such as a driver's license, some money and possibly a credit card. Also, if an individual is active in sports, such as jogging, again, it would only be necessary for that individual to have with him the just previously mentioned items not requiring the need of the entire wallet.

In the past, there have been attempts to design wallets which included a separate small wallet which is to be removable from the main wallet. Examples of such wallets are what are shown and described within U.S. Pat. No. 2,438,655, issued Mar. 30, 1948 to a Milton Becker and U.S. Pat. No. 4,037,634, issued July 26, 1977 to a Frank M. Ricciardi. Both of these prior art wallets and their accompanying sub-wallets constitute no more than a scaled down, normally closeable small wallet within which is located a single compartment. Neither of these prior art sub-wallets are designed to have certain advantages as it is being used.

SUMMARY OF THE INVENTION

One embodiment of the structure of the present invention is directed to a small wallet which incorporates primarily a pair of compartments. Access into one of the compartments is through the top edge, with access into the other compartment being through the side edge. The top edge compartment is designed to contain currency. Included also within this top edge compartment is a separate small compartment to contain a conventional key such as is frequently used to open a door of a house or a vehicle. The side edge compartment has a transparent outer panel which is to permit visibility into the side edge compartment. The reason for the visibility is that the side edge compartment is designed to have contained therein a form of identification such as a driver's license and, therefore, the driver's license can be observed without requiring removal from the wallet. This side edge compartment is also designed to accommodate credit cards. Both the top edge compartment and the side edge compartment are designed so that the normal at-rest position of the wallet keeps these compartments substantially closed preventing accidental dislodgement of any of the contents within either of the compartments. This small wallet is of a size to be readily locatable within a compartment of a large wallet. There is a modified form of a small wallet in which access into both compartments is through the top edge. The compartment that is designed to contain currency is divided, by a divider wall, into two separate compartments with one of these compartments being designed to contain currency and the other compartment to contain a key or other type of structure. This divided compartment is to be normally closed by a mating pair of hook and eye engaging strips.

The primary objective of the present invention is to construct a small sized wallet which accommodates in a convenient manner certain articles which are frequently needed in normal day-to-day living and this small sized wallet being readily locatable and be part of a larger sized wallet when it is necessary that the larger sized wallet be carried by a human being.

Another objective of the present invention is to construct a wallet to be manufactured inexpensively and therefore sold to the ultimate consumer at an inexpensive price.

DETAILED DESCRIPTION OF THE SHOWN EMBODIMENT

Figure 1:
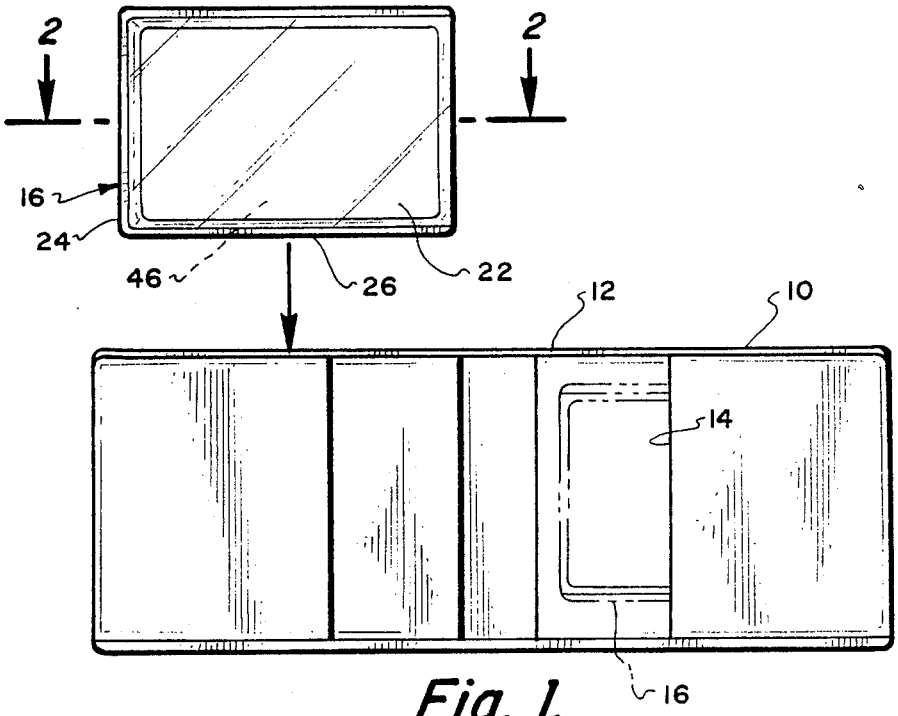
FIG. 1 is a front elevational view of a conventional large sized wallet shown in a partially open condition and the small sized wallet of the first embodiment of this invention about ready to be inserted into this large sized wallet.
Figure 2:
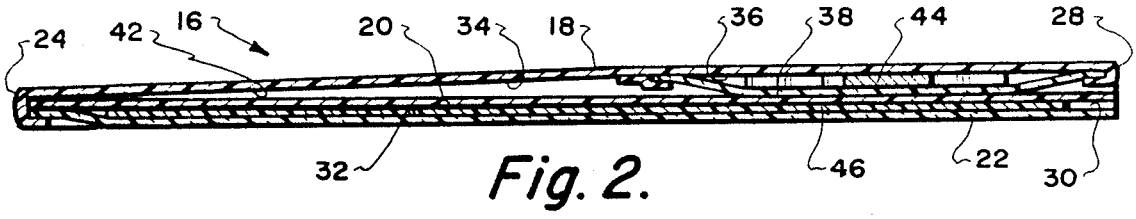
FIG. 2 is a cross-sectional view through the small sized wallet of the first embodiment of this invention taken along line 2—2 of FIG. 1.

Referring particularly to the drawing, there is shown a conventional large sized wallet 10 which has an elongated currency containing compartment 12 and a smaller sized article containing compartment 14. Normally this wallet 10 will be constructed of leather, plastic or other similar type of sheet material. Locatable within the compartment 12 is the small wallet 16 of this invention. Also, shown in FIG. 1, is a small wallet 16 located within a compartment 14 with this wallet 16 being shown in phantom. It is to be understood that it is an option that the wallet 16 can be located within compartment 14 or the compartment 12 or any other desired compartment of the large wallet 10. It is to be understood that in connecting the small wallet 16 within the large wallet will not interfere with the normal folding or collapsing of the large wallet 10 to place such within one's pocket or other similar type of use of the large wallet 10.

The small wallet 16 of this invention is constructed of three in number of panels 18, 20 and 22. Basically, panels 18, 20 and 22 are located in juxtaposition and are formed of a thin opaque sheet material such as plastic.

The exception is panel 22 which is formed of a clear or transparent plastic.

Figure 3:
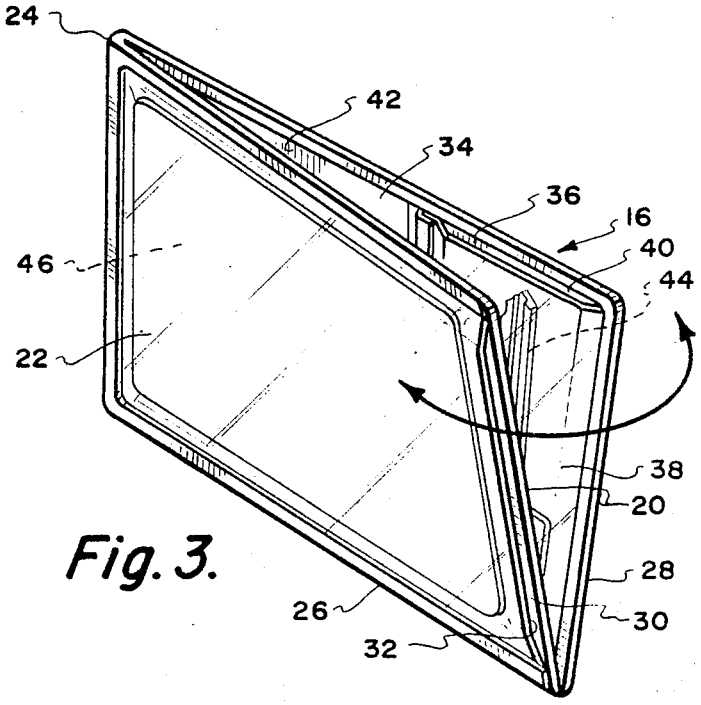
FIG. 3 is an isometric view of the first embodiment of the small sized wallet of this invention showing this small sized wallet in a partially exploded configuration.
Figure 4:
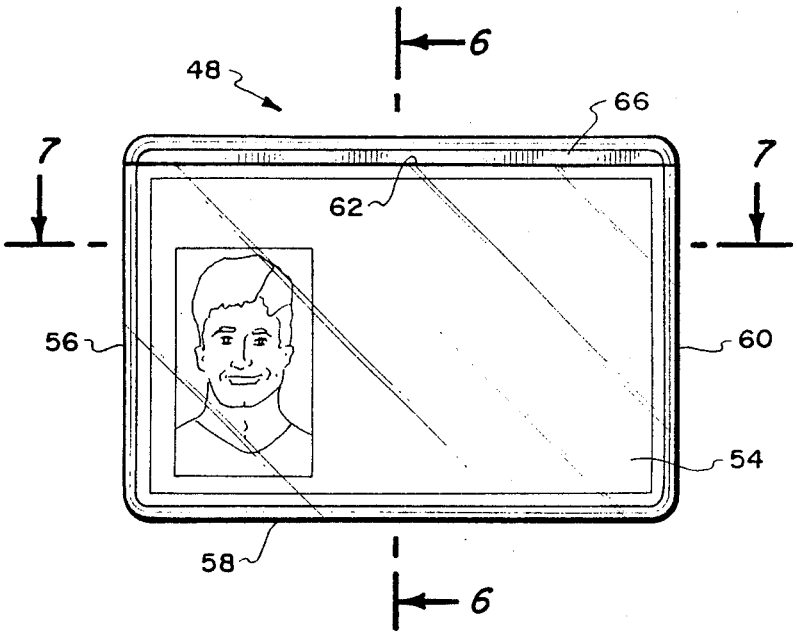
FIG. 4 is a front elevational view of the second embodiment of this invention.
Figure 5:
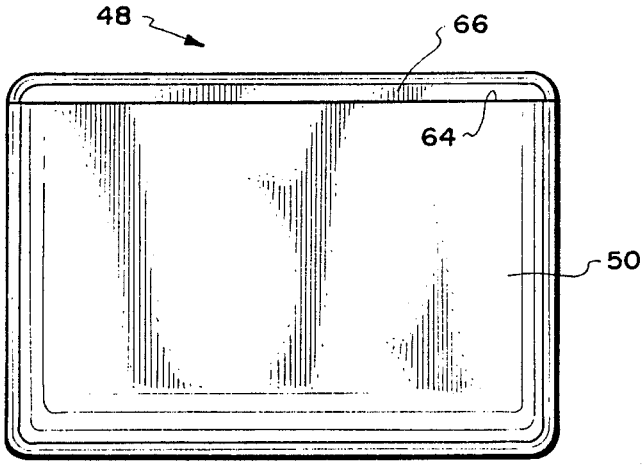
FIG. 5 is a back elevational view of the second embodiment of the small wallet of this invention.
Figure 6:
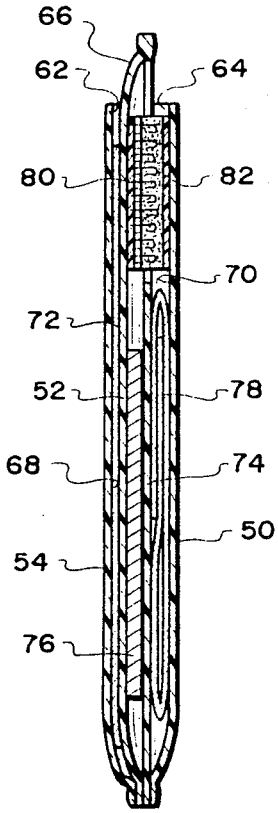
FIG. 6 is a cross-sectional view taken along line 6—6 of FIG. 4.
Figure 7:
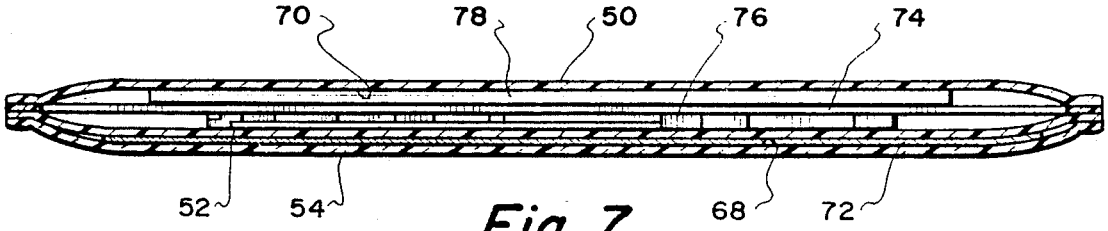
FIG. 7 is a cross-sectional view taken along line 7—7 of FIG. 4.

The panels 18, 20 and 22 are located in an abutting, flat configuration with the peripheral edges aligned. The overall configuration of the small wallet 16 is that of a polygonal configuration with the preference being rectangular. The peripheral edges 24 and 26 are completely sealed. Peripheral edge 28 is also completely sealed with the exception of access opening 30 which provides a side opening into compartment 32. Compartment 32 is observable exteriorly through transparent panel 22. Located within the compartment 32 is a conventional credit card 46. It is to be noted that within FIG. 3 of the drawing, the panel 20 is shown disengaged from the panel 18. This is only for reasons of illustration and that in actual practice, panel 20, in the area alongside of access opening 30, will be sealed to panel 18 by side edge 28.

Located between the panels 18 and 20 is a compartment 34. Compartment 34 is for the purpose of containing currency with the compartment 32 being designed primarily for containing identifying indicia such as a driver's license and/or credit cards. Within the compartment 34 is located a completely separate small sized compartment 36. This compartment 36 is formed by small panel 38 which is fixedly mounted to the inside surface of the panel 18. Access into the compartment 36 is provided through access opening 40 which is located alongside of the access opening 42 into the compartment 34. Both access openings 40 and 42 are located along the top edge of the wallet 16. The size of the compartment 36 is adapted to contain, in a snug fitting manner, a key 44.

Referring particularly to FIGS. 4 through 7 of the drawings, there is shown the second embodiment 48 of small sized wallet of this invention. The wallet 48 is constructed also of three in number of panels 50, 52 and 54. The panels 50, 52 and 54 are also located in juxtaposition and are formed of a thin opaque sheet material such as plastic. Again, the exception is panel 54 is formed of a clear or transparent plastic.

The panels 50, 52 and 54 are also located in an abutting, flat, configuration with the peripheral edges being aligned. The overall configuration of the wallet 48 is polygonal with the shape being essentially identical to that of wallet 16. The peripheral edges 56, 58 and 60 are completely sealed. The remaining edge, which is the top edge, is not sealed forming access opening 62 between panels 52 and 54 and access opening 64 between panels 50 and 52. Also located at the top edge is an outer extension 66 of wall 52 which extends a short distance away from the aligned access openings 62 and 64. The reason for the wall 66 is to facilitate manual entry into both access openings 62 and 64 by making it easier to open the openings 62 and 64 with the finger of a human being inserted between the wall 66 and panel 50 or panel 54.

Access opening 62 is to provide accessibility into compartment 68. In a similar manner, the access opening 64 is to provide accessibility to compartment 70. Compartment 68 is exteriorly through panel 54 since panel 54 is transparent. Compartment 70 is not observable exteriorly observable panel 50 is opaque. The reason for the transparency of panel 54 is to facilitate observing the documents, such as a driver's license 72, located within the compartment 68.

The compartment 70 is actually divided by divider panel 74 into two separate compartments. Within one of these separate compartments there is to be located a rigid structure such as a door key 76 with the other of these separate compartments adapted to receive folded paper currency 78. However, it is to be understood that the particular items placed within these separate compartments is deemed to be a matter of choice.

Adhesively secured to the panel 52 and located within the confines of the compartment 70 is a hook securing strip 80. An eyelet securing strip 82 is adhesively secured to the panel 50 and is also located within the compartment 70. The securing strips 80 and 82 are of identical length and are slightly less than the length of the compartment 70. The strips 80 and 82 are in juxtaposition and tightly engaged together to close the compartment 70. However, the strips 80 and 82 are manually separable to permit access into the compartment 70. The strips 80 and 82 are of a conventionally available securing device which is commonly sold under the tradename of VELCRO.

It is to be understood that all seals connecting together the different panels of the wallets 16 and 48 of this invention are to be accomplished either through heat sealing or by direct sewing. However, any other conventional manner of providing a seal could be utilized without departing from the scope of this invention.

What is claimed is:

1. In combination with a large wallet, said large wallet having an internal article carrying compartment, a small wallet locatable within said article carrying compartment and totally confined therein, said small wallet removable from said article carrying compartment and separately carryable, said small wallet comprising:

three in number of thin-walled sheet material panels located in juxtaposition defining a first compartment and a second compartment, one of said panels forming a common wall for both said first compartment and said second compartment, said panels being of a polygonal configuration when observed flat-wise, said panels having peripheral edges including a top edge, said peripheral edges being secured together with the exception of said top edge, said top edge including a first access opening and a second access opening, said first access opening providing access into said first compartment, said second access opening providing access into said second compartment, a mating strip attachment mounted in conjunction with said second access opening, said opening, said mating strip attachment being locatable in either a closed position or an open position, said open position permitting access into said second compartment, said closed position preventing access into said second compartment, said common wall having an extension extending a spaced distance from said access opening so therefore said common wall being of a height greater than the remaining two said panels, said top edge of said remaining two said panels being lineal, said extension facilitating manual access through said access openings into and out of said first and second compartments;

the outer said panel of said first compartment being transparent with the remaining said panels being opaque; and a divider wall located within said second compartment, said divider wall dividing said second compartment into a pair of separate compartments, one of said separate compartments being for the purpose of accommodating a conventional flat door key and the other of said separate compartment to accommodate folding currency.

* * * * *